United States Patent [19]

Schröder

[11] 3,978,899

[45] Sept. 7, 1976

[54] CLOSURE FOR A STEEL BAND OR STRAP PLACED AROUND ONE OR MORE ARTICLES AND METHOD AND DEVICE FOR MAKING SAID CLOSURE

[75] Inventor: Theodor Schröder, Wuppertal-Beyenburg, Germany

[73] Assignee: Titan Verpackungs System GmbH, Schwelm, Germany

[22] Filed: Mar. 24, 1975

[21] Appl. No.: 561,030

[30] Foreign Application Priority Data

Mar. 22, 1974 Germany ..... 2413889
Mar. 22, 1974 Germany ..... 2413890

[52] U.S. Cl. ..... 140/93.2; 29/521; 403/285

[51] Int. Cl.[2] ..... B21F 15/04

[58] Field of Search ..... 140/93.2, 93.4; 29/514, 29/521; 403/282, 285; 100/29, 33

[56] References Cited

UNITED STATES PATENTS

| | | | |
|---|---|---|---|
| 2,023,059 | 12/1935 | Vaughan | 29/521 |
| 2,097,945 | 11/1937 | Childress | 140/93.2 |
| 2,426,670 | 9/1947 | Cooley | 403/285 |
| 3,726,000 | 4/1973 | Hafner | 29/521 |

*Primary Examiner*—Lowell A. Larson
*Attorney, Agent, or Firm*—Walter Becker

[57] ABSTRACT

A closure band and a method for interconnecting the overlapping ends of the band and an apparatus for making the connection in which incisions are formed laterally into the opposite edges of the superimposed band ends to form tabs along the band edges. The tabs are bent out of the plane of the band ends so that the tabs on the edges of one band are disposed within the tab spaces of the other band end. The tabs are advantageously formed so as to be wider at the outer free ends than the spaces on the other band ends on which the tabs are disposed, whereby the band ends are fixedly interconnected in tension transmitting relation.

6 Claims, 21 Drawing Figures

FIG. 1
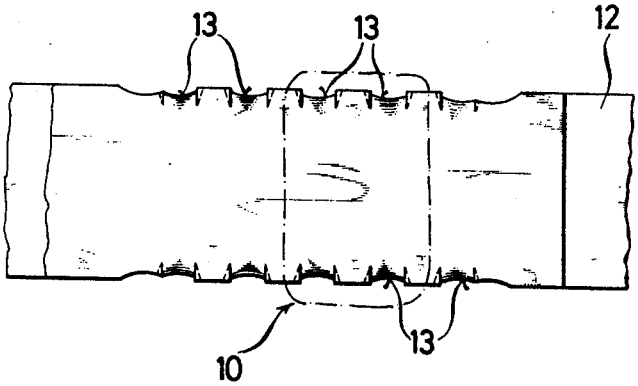
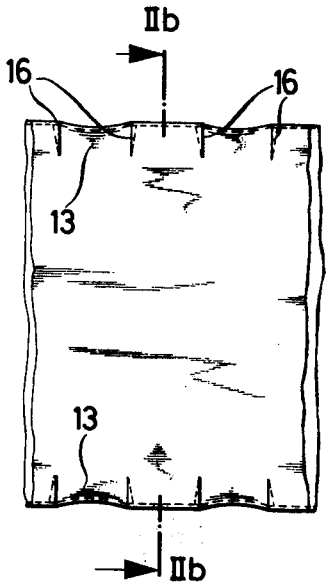
FIG. 2
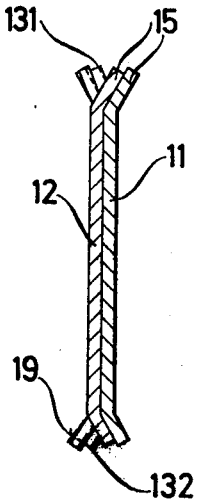
FIG. 2b
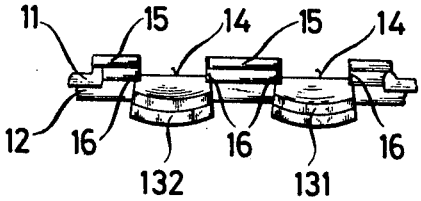
FIG. 2a

FIG. 10
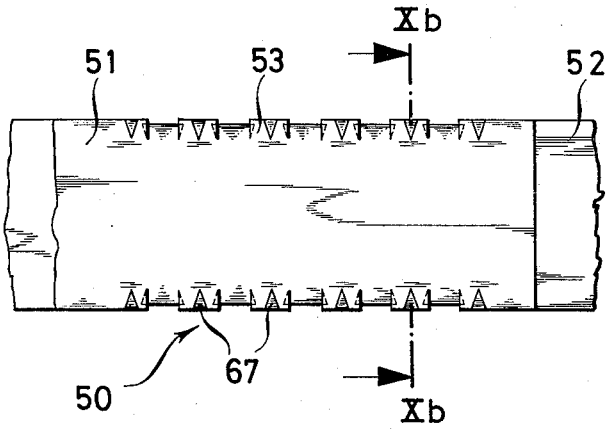
FIG. 10b
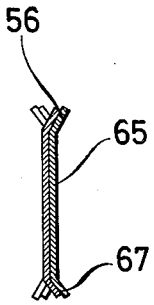
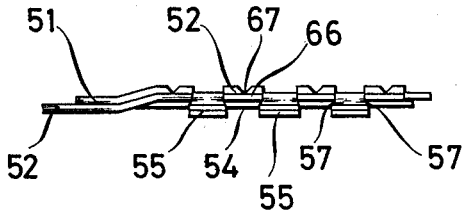
FIG. 10a

CLOSURE FOR A STEEL BAND OR STRAP PLACED AROUND ONE OR MORE ARTICLES AND METHOD AND DEVICE FOR MAKING SAID CLOSURE

The present invention relates to a closure for a steel band or strap which has been placed around packed articles and which is provided with two overlapping band ends with which by cutting the two band edges ears are formed which are bent out of the plane of the band. A closure of this type has become known which is made by two parallel cuts into the overlapping band ends which cuts are effected from the side edges transverse to the direction of the band so that two ears are formed, whereupon the ears are by 180° rolled or bent to the bottom side of the band. This requires a relatively long cut with a corresponding weakening of the cross section.

The thus made closure has the drawback that it can be produced only with a soft steel band of low brittleness. With high strength, the ears would break off when being bent. The side bending is necessary in order to prevent the band ends from separating or lifting themselves off each other.

It is an object of the present invention to provide a closure as well as a method and a device which with a steel band or strap of high strength will prevent a lifting off of the band ends from each other and will correspond approximately to the strength of the band.

These and other objects and advantages of the invention will appear more clearly from the following specification, in connection with the accompanying drawings, in which:

FIG. 1 illustrates a closure according to the present invention.

FIG. 2 shows on a larger scale that portion of FIG. 1 which is encircled by a dot-dash line.

FIG. 2*a* is a top view of FIG. 2.

FIG. 2*b* is a section taken along the line II*b*—II*b* of FIG. 2.

Figure 3:
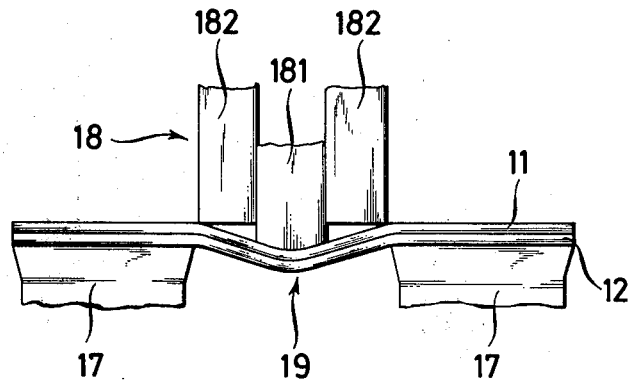
Figure 4:
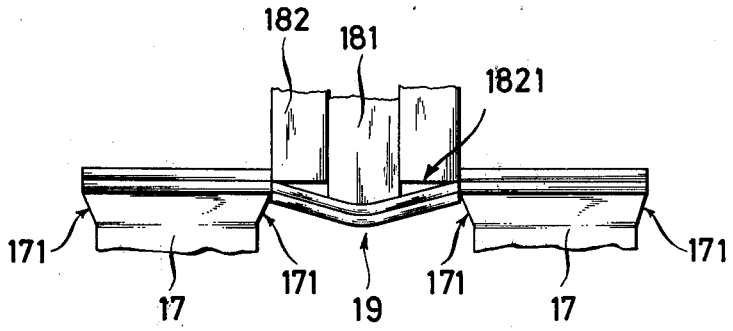
Figure 5:
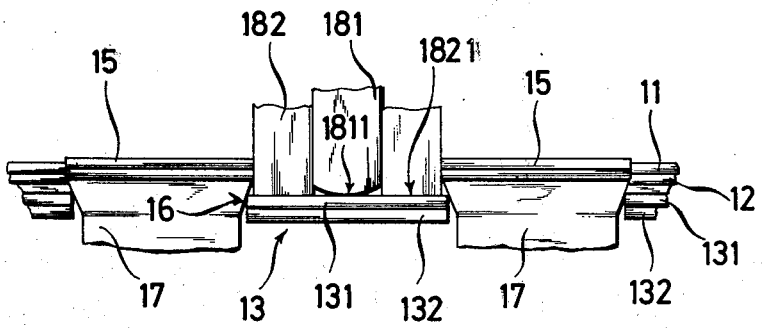

FIGS. 3, 4 and 5, respectively illustrate individual working steps when making the closure according to the invention.

Figure 6:
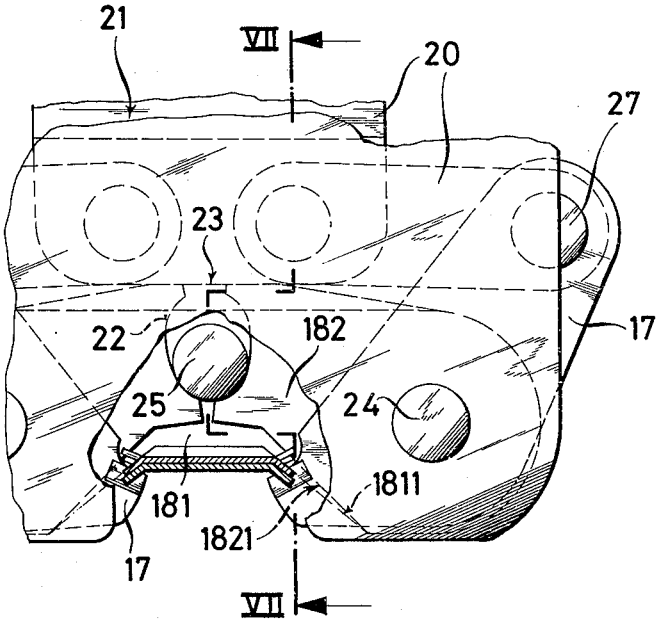

FIG. 6 shows a view of that portion of the device which forms the closure.

Figure 7:
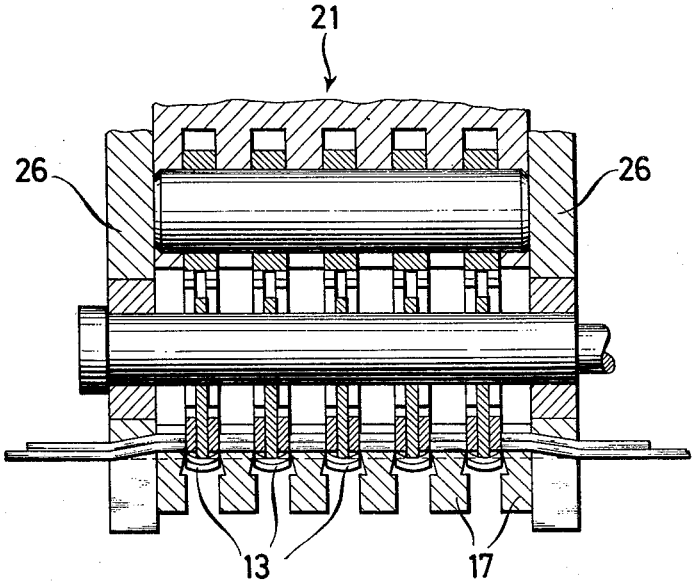

FIG. 7 is a section taken along the line VII—VII of FIG. 6.

Figure 8:
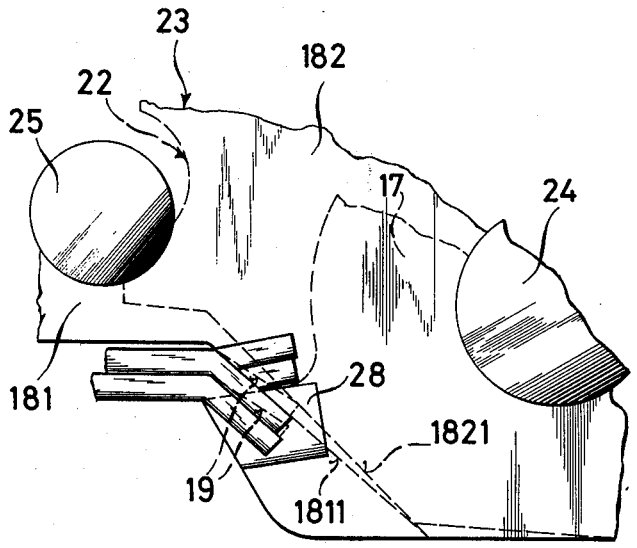

FIG. 8 illustrates a somewhat larger view of that portion of FIG. 6 which is encircled by a dot-dash line.

Figure 9:
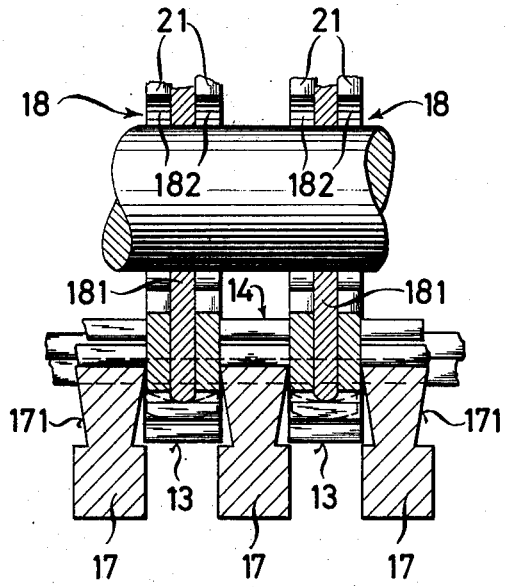

FIG. 9 shows a correspondingly enlarged section encircled by a dot-dash line in FIG. 7.

FIG. 10 shows a modified closure according to the invention.

FIG. 10*a* is a portion of a top view of FIG. 10.

FIG. 10*b* is a section taken along the line X*b*—X*b* of FIG. 10.

Figure 11:
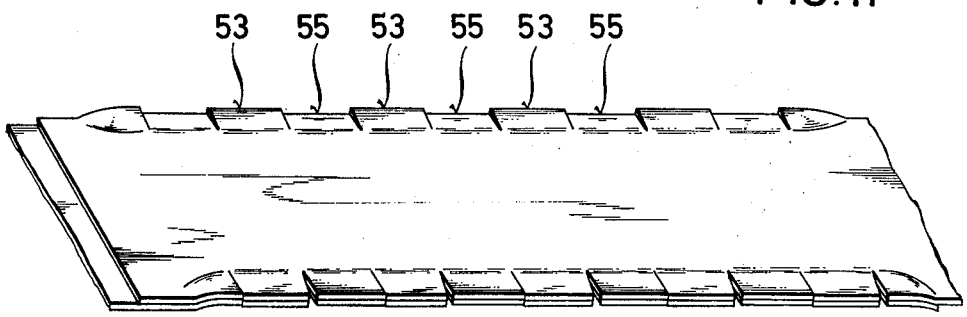
Figure 12:
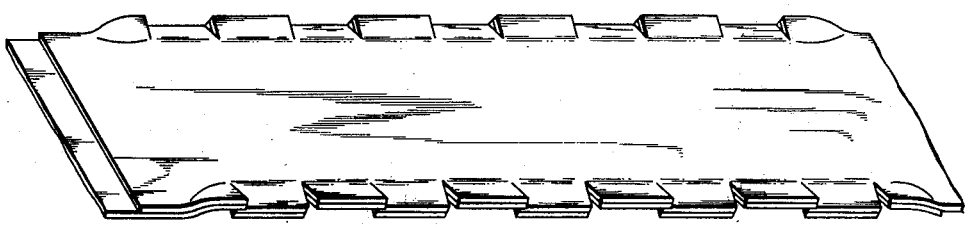
Figure 13:
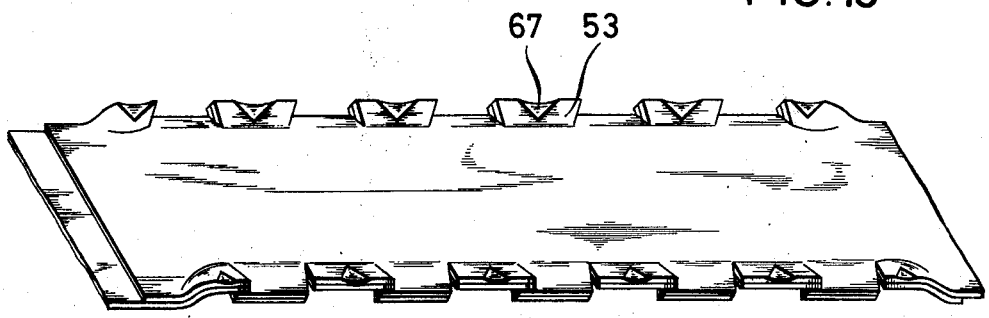

FIGS. 11, 12 and 13, respectively illustrate individual steps in the making of the closure according to the invention.

Figure 14:
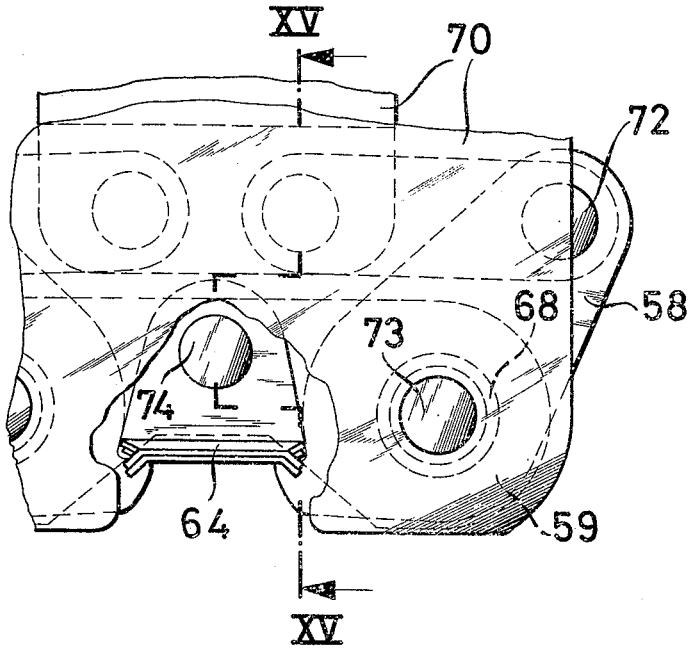

FIG. 14 shows a view of that portion of the device which forms the closure.

Figure 15:
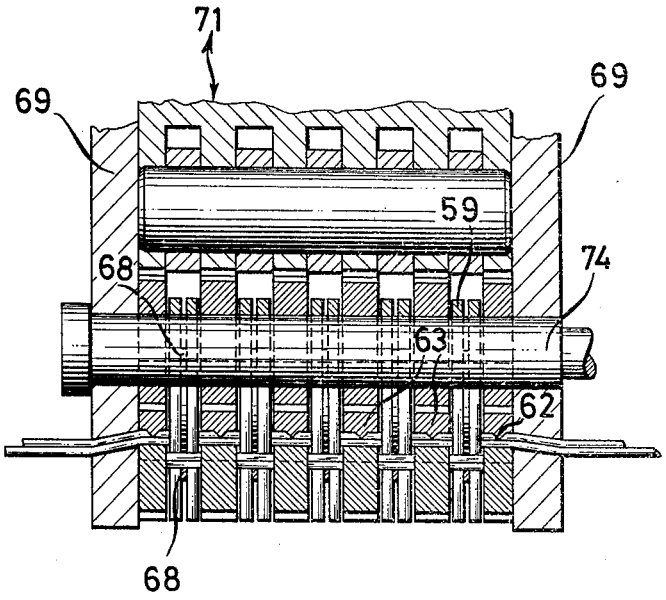

FIG. 15 is a section taken along the line XV—XV of FIG. 14.

Figure 16:
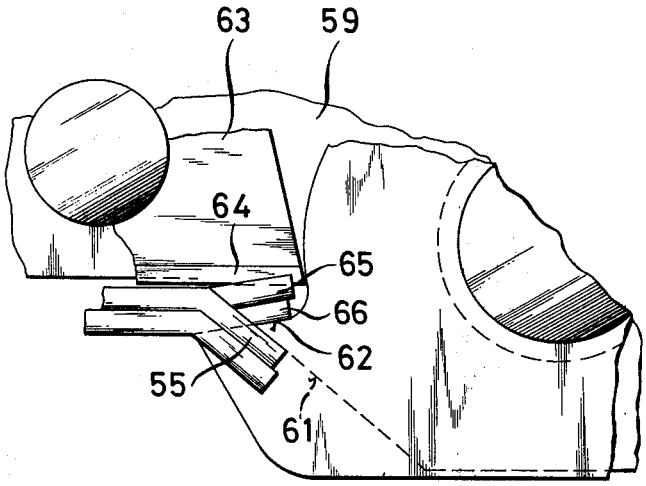

FIG. 16 illustrates on a larger scale that portion of FIG. 14 which is shown therein encircled by a dot-dash line.

Figure 17:
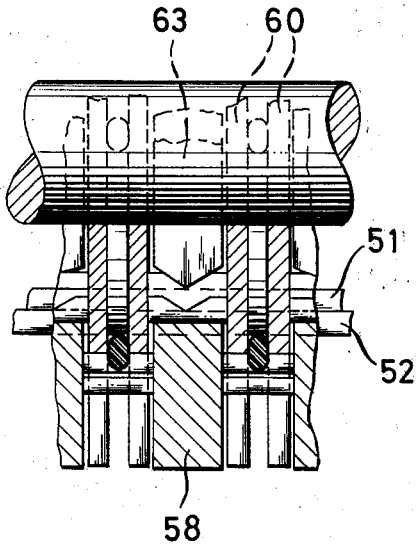

FIG. 17 shows on a larger scale a corresponding portion of FIG. 14 encircled therein by a dot-dash line.

The closure for a steel band or strap placed around one or more articles with two overlapping band ends with which by cuts at the two band ends ears are formed and bent out of the band plane is, according to the present invention, characterized primarily in that the ears or flaps which are bent out of the band plane in downward direction substantially transverse to the band direction are widened parallel to the longitudinal direction of the band, and the ears or flaps of the upper band end with one part of their side edges catch behind the side edges of the tongues of the lower band end, which tongues are bent upwardly out of the band plane or remain in the band plane.

A method of making the closure according to the invention consists primarily in that by shrinking (Krimpung) the overlapping band ends are locally arched on the band ends whereupon by cutting arched ears or flaps are formed which are bent out of the band plane and by expanding or drawing are placed in a direction opposite to the arching.

For carrying out the method according to the invention, partial use of a device is made as it is disclosed in U.S. Pat. No. 3,698,310 for sleeve closures, according to which through the intervention of an elbow lever arrangement movable lower cutting blades are arranged opposite movable upper cutting blades. The method according to the invention, however, cannot be carried out with this heretofore known device. In order to permit the carrying out of the method according to the invention, an inventive step has been taken which consists primarily in that the upper cutting blades respectively consist of three parallel discs while the intermediate disc is rigid and the two outer discs are movably arranged between the holding bolts of the pivotable cutting blades.

A very simple construction of the tool according to the invention is characterized in that the two outer discs respectively are designed of two pieces and on one hand are rotatably mounted on the holding bolt, and on the other hand are by means of a fork-shaped recess limited as to their cutting movement on a bolt.

It is furthermore advantageous that the outer discs at those ends which have the fork-shaped recesses are operatively connected to the elbow levers.

Referring now to the drawings in detail, FIG. 1 shows the closure 10 of a band or strap of steel of high strength which is looped around a non-illustrated article to be packed, and in which the band ends overlap each other and by cutting the band ends in the upper band 11 and the lower band 12 ears or flaps 13 are formed and are bent out of the band plane.

The ears 13 which are bent out of the band plane in downward direction are wider than the cutout 14 between two tongues 15 which are bent out of the band plane in upward direction or remain in the band plane. The ears 131 in the upper band 11 engage with a portion of their lateral edges behind the lateral edges of the tongues 15 of the lower band 12 at the overlapping points 16.

The method for making the closure 10 comprises the following steps. During the first step by shrinking, the overlapping band ends 11, 12 are locally arched as will be evident from FIG. 3. To this end, in the tool a movable lower cutting blade 17 is moved against an intermediate rigid disc 181 of the upper cutting blade 18 whereby movable discs 182 which at this point have a play are pressed upwardly by means of the upper band 11 and the lower band 12. As a result thereof, on the band edge at the working surface 1811 of the rigid disc 181 the arch 19 is formed by a plastic deformation. The method comprises the second working step which consists in that during a further movement of the lower cutting blade 17 the movable discs 182 are cut in arched condition at the cutting edges (FIG. 4).

The last working step consists in that elbow lever arrangement 20 (FIG. 6) is further actuated in the direction of the arrow 21, whereby said elbow lever arrangement enters into operative condition with the end parts 23 of the divided disc 182 which are movable about the holding bolts 24, said end parts 23 comprising fork-shaped recesses 22. As a result thereof, these discs are with their working surfaces 1821 pressed downwardly, and the discs 13 are expanded or stretched parallel to the longitudinal direction of the band in a direction opposite to the arch 19 (FIG. 5). This movement is limited by the cooperation of the fork-shaped recess 22 with the bolt 25. During the expansion or stretching of the ears 13, the material will be widened, which action is possible by the undercut 171 of the lower cutting blade 17 so that the described catching from behind of the ears 13 is possible at the overlapping point 16 by means of the tongues 15. The withdrawal or returning of the lower cutting blade 17 when opening and removing the work tool aids this operation by an additional bending back of the ears 13 and offers no difficulties inasmuch as the widening of the ears 13 is effected within the range of tenths of millimeters.

A closure 10 produced in this way has with a steel band of 16 × 0.5 mm 80% of the band strength with five ears 13 on each band edge with a cutting length of 1.5 mm transverse to the longitudinal direction of the band.

The device according to the invention is illustrated in FIGS. 6 to 9. Only that part is illustrated which forms the closure 10 and which can be actuated in any known manner pneumatically or through the intervention of hand operated levers.

Between two cover plates 26 there is movably arranged an elbow arrangement 20 which is movable in or opposite to the direction of the arrow 21. The lower cutting blades 17 may have a hard metal edge 28. Of the upper cutting blade 18 consisting of three parallel discs, the intermediate rigid discs 181 as well as also unilaterally the divided movable discs 182 are mounted on the holding bolts 24.

Another bearing point of the movable disc 182 is formed on the bolt 25 by fork-shaped recesses 22 in the end parts 23 of the discs 182. Inasmuch as the fork-shaped recess 22 is greater than the diameter of the bolt 25, the discs are in conformity with this play movable as long as the elbow lever arrangement 20 is not in operative engagement with the end parts 23. Such operative engagement occurs only when the elbow lever arrangement 20 has fully lowered in the direction of the arrow 21.

It is self-understood that after the closure has been formed, the steel band which is fed from a non-illustrated supply is separated in a manner known per se from the belt supply.

Referring now to FIG. 10, this figure shows a closure 50 of a strap of steel of high strength wound around a non-illustrated article or articles to be wrapped, according to which the band ends overlap each other and by cutting the band edges in the upper band 51 and the lower band 52, ears or flaps 53 are formed which are bent out of the band plane.

The ears 53 which are bent out of the band plane in upward direction are wider than the cutout 54 between two tongues 55 which are bent downwardly out of the band plane. The ears 56 provided in the lower band 52 extend with a portion of their side edges behind the side edges of the tongues 54 of the upper band 51 of the overlapping points 57. The method of making the closure 50 consists in that during a first working step, as evident from FIG. 11, ears 53 are formed by cutting the upper band 51 and lower band 52.

To this end in the tool, movable lower cutting blades 58 are moved against the upper cutting blades 59. An upper cutting blade 59 consists of two discs 60 which are parallel to each other and arranged in spaced relationship to each other while the bent edges are cut at the cutting edges 61 of said discs 60. The second working step consists in that during further movements of the lower cutting blades 58, the ears 53 are by the bending surfaces 62 bent outwardly out of the band plane and the tongues 55 are along the cutting edges 61 at the upper cutting blades 59 bent downwardly out of the band plane.

The last working step for making the closure according to the embodiment of FIG. 10 consists in that the lower cutting blade 58 presses the ears 53 respectively against a notch member 63 in which connection a cutting blade 64 embosses itself into the upper end 65. As a result thereof, an upsetting of the ear 65 occurs in a direction parallel to the longitudinal direction of the band. This upsetting is conveyed also to the lower ears 66 so that the described catching from behind of the ears 53 is possible at the overlapping point 57 by means of the tongues 55. The widening caused by the notch 67 is made possible by the fact that between the discs 60 a spring element 68 is provided, for instance, an elastic O-ring, which permits a transverse movement of the discs 60.

The closure 50 produced in this manner has with a steel band of 60 × 0.5 mm 80% of the band strength while comprising five tongues 55 on each band edge with a cutting length of 1.5 mm transverse to the longitudinal direction of the band.

The device is illustrated in FIGS. 14 – 17. Only that portion is illustrated which forms the closure 50 and which can be actuated in a known manner pneumatically or through the intervention of manually operable levers. Between the two cover plates 69 there is arranged an elbow lever system 70 which is movable in and opposite to the direction of the elbow 71.

The lower cutting blades 58 are pivotally journaled on one hand, on the bolt 72 and on the other hand on the bolt 73. The upper cutting blades 59 which consist of two parallel discs 60 are journaled on the holding bolts 73. Between the discs 60 and on the holding bolt 73 there is provided a spring element 68 whereby the width of the upper cutting blade 59 is variable when said upper cutting blades are subjected to lateral pressure. To this end, the discs 60 are arranged on the holding bolts 73 so as to be displaceable in transverse direction. Respectively, between each pair of the upper cutting blades 59 on the bolt 74 there are mounted notch members 63 so that one notch member each is located opposite the bending surfaces 62 of the lower cutting blades 58. The notch members 63 have a cutting edge 64 by means of which the notch 67 in the ears 53 is produced.

After the closure has been formed, the steel band coming from a non-illustrated supply is separated from the band supply.

It is, of course, to be understood that the present invention is, by no means, limited to the specific showing in the drawings, but also comprises any modifications within the scope of the appended claims.

I claim:

1. An apparatus for connecting the overlapping ends of a closure band to secure the band ends together in tension transmitting relation which comprises; a pair of cutting devices adapted to receive therebetween the band ends in superposed face to face relation, said cutting devices being operable upon movement toward each other to cut pairs of lateral incisions into the edges of the band ends to form tabs on the band edges between the pairs of said incisions, said cutting devices also bending the tabs out of the planes of the bands to dispose the tabs on the edges of one band end in the space between a respective pair of incisions in the edges of the other band end, said cutting devices comprising first movable cutting blades engaging one band end at opposite sides of the tab to be formed therein and a second cutting blade engaging the other band end in the region of the tab, said second cutting blade having a nonmovable part engaging the center region of the tab and movable parts on each side of the nonmovable part engaging the side regions of the tab, and means for controlling the movement of said first cutting blades and the movable parts of said second cutting blade.

2. An apparatus according to claim 1 in which said parts of said second cutting blade are in the form of discs, bolt means extending through said discs and rigidly supporting said nonmovable part, said movable parts being pivotal on one of said bolt means and comprising abutment means cooperating with another of said bolt means to limit the amount of movement of said movable parts.

3. An apparatus according to claim 2 which includes an actuator connected to said first cutting blades to move the first cutting blades toward the second cutting blade, said actuator being engageable with said movable parts for movement thereof toward said first cutting blades following the cutting of said incisions.

4. An apparatus according to claim 3 in which said actuator is connected to said first cutting blades by links which extend substantially perpendicularly to the direction of movement of said actuator when said actuator engages said movable parts of said second cutting blade.

5. An apparatus for connecting the overlapping ends of a closure band to secure the band ends together in tension transmitting relation which comprises; a pair of cutting devices adapted to receive therebetween the band ends in superposed face to face relation, said cutting devices being operable upon movement toward each other to cut pairs of lateral incisions into the edges of the band ends to form tabs on the band edges between the pairs of said incisions, said cutting devices also bending the tabs out of the planes of the bands to dispose the tabs on the edges of one band end in the space between a respective pair of incisions in the edges of the other band end, said cutting devices comprising a blade on each of the upper and lower sides of a tab region and further cutting blades at the sides of said first mentioned blades, said further blades each comprising a pair of plates and spring means acting therebetween to permit the plates to move toward each other under pressure, said first mentioned blades including means for notching or upsetting the free outer ends of the tabs formed thereby.

6. An apparatus according to claim 5 in which said spring means comprise resilient O-ring means.

* * * * *

UNITED STATES PATENT OFFICE
CERTIFICATE OF CORRECTION

Patent No. 3,978,899 Dated September 7 1976

Inventor(s) Theodor Schroder

It is certified that error appears in the above-identified patent and that said Letters Patent are hereby corrected as shown below:

On the cover sheet Item (73) has been changed to read:

-- Titan Verpackungssysteme GmbH, Schwelm, Germany --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*